US011279384B2

(12) United States Patent
Vega et al.

(10) Patent No.: US 11,279,384 B2
(45) Date of Patent: Mar. 22, 2022

(54) ROBOTIC SYSTEM FOR INSTALLING EQUIPMENT ON VERTICAL SURFACES OF RAILWAY TUNNELS

(71) Applicant: Reliabotics, LLC, New Brunswick, NJ (US)

(72) Inventors: Juan Vega, New Brunswick, NJ (US); Frank Thissen, New Brunswick, NJ (US); John Morgan, New Brunswick, NJ (US); Arun Aruljothi, New Brunswick, NJ (US)

(73) Assignee: Reliabotics, LLC, New Brunswick, NJ (US)

( * ) Notice: Subject to any disclaimer, the term of this patent is extended or adjusted under 35 U.S.C. 154(b) by 340 days.

(21) Appl. No.: 16/408,474

(22) Filed: May 10, 2019

(65) Prior Publication Data

US 2020/0353955 A1 Nov. 12, 2020

(51) Int. Cl.
*B61D 15/00* (2006.01)
*B61L 3/00* (2006.01)

(52) U.S. Cl.
CPC ..... *B61D 15/00* (2013.01); *B61L 3/00* (2013.01)

(58) Field of Classification Search
CPC ..... B61D 15/00; B61D 15/02; B61D 15/08; B61L 3/00; E01B 9/00; E01B 9/02; E01B 9/22; E01B 9/28; E01B 29/00; E01B 29/24; E01B 29/28; E01B 29/32; E01B 37/00
See application file for complete search history.

(56) References Cited

U.S. PATENT DOCUMENTS 4,645,084 A * 2/1987 Deike ..... B25J 9/046 173/194
4,921,732 A 5/1990 Bounds
6,330,503 B1 12/2001 Sharp et al.
8,061,277 B2 * 11/2011 Jacob ..... B66C 23/50 105/72.2
8,583,313 B2 11/2013 Mian

FOREIGN PATENT DOCUMENTS

EP 0304342 2/1989
EP 1327567 7/2003
JP 0664544 3/1994

* cited by examiner

*Primary Examiner* — Robert J McCarry, Jr.
(74) *Attorney, Agent, or Firm* — LaMorte & Associates P.C.

(57) ABSTRACT

An automated system and method of mounting wayside equipment on a surface that is adjacent to railway tracks. A robot is carried by a railway car with an included odometry system. The robot has an articulating arm that can reach between the railway car and an adjacent wall. The robot is provided with working head units. The robot can connect to, and disconnect from, the various working head units in order to perform different tasks. The tasks performed by the robot include scanning the wall for defects and obstructions that may prevent a proper mounting, drilling holes in the wall, mounting bolts in the holes, mounting brackets to the bolts, and connecting electronics units to the brackets. The robot can optionally clean the mounting site and test the mounting site for signal strength.

14 Claims, 10 Drawing Sheets

ROBOTIC SYSTEM FOR INSTALLING EQUIPMENT ON VERTICAL SURFACES OF RAILWAY TUNNELS

BACKGROUND OF THE INVENTION

1. Field of the Invention

In general, the present invention relates robotic systems that are designed and programmed to install wayside equipment on vertical surfaces. More particularly, the present invention relates to robotic systems that are mounted to rail cars and are used to install equipment on the surfaces of railway tunnels.

2. Prior Art Description

Many railway systems have trains that pass through tunnels. In certain cities, the railway systems are subways, wherein most of the train routes are directed through underground tunnels. In many instances, some of the tunnels can be over a century old. In this long period of time, the walls of the tunnel have been exposed to many contaminants. As such, many of the tunnel walls between stations are coated in thick deposits of dirt and grime. Furthermore, walls of many tunnels are riddled with cracks, old equipment mounts, running cables, and the like.

As railway systems modernize, so do the control systems utilized by those railway systems. Old mechanical switches that are used to detect the presence of a train are being replaced with more modern electronic sensors. The electronic sensors mount to the surfaces of a tunnel and detect the presence and/or absence of a train in a particular section of the tunnel. The sensor data is then communicated to a central control facility through a data network.

There are many problems associated with modernizing transit system by adding electronic sensors and other modern wayside equipment to railway tunnels. Most of the problems are associated with positioning and installation of the needed electronic sensors. In an underground tunnel, the various electronic sensors must be positioned within the line of sight of the previously installed sensor. This means that if a tunnel dips, rises and/or turns, then dozens of sensors may have to be installed per running mile of track. Furthermore, those sensors must be installed at mounting positions on the surfaces of the tunnels that are appropriate. Such mounting positions must meet many criteria and are rare in older tunnels. Mounting positions must not be obstructed by poles or other equipment. Mounting positions cannot be compromised by joint seams, cracks or crumbling concrete. Mounting positions must be clear of the moving train and railway maintenance equipment. Lastly, mounting positions must be clear of cables, tunnel mounted equipment, and dripping water. When considered cumulatively, there are actually very few locations on a tunnel wall that are well suited for receiving an electronic sensor. The few locations that are appropriate are often difficult to reach and the sensor units must be mechanically mounted into the material of the wall. This further limits the number of locations that a sensor unit can be placed because many selected locations get damaged or otherwise are discovered to be inappropriate during the mechanical installation process.

It will therefore be understood that mounting electronic sensors in a railway tunnel is a complex, labor intensive and time-consuming process. Appropriate locations for mounting sensors must be located that meet both the line-of-sight and mounting surface criteria. The selected locations must then be cleaned and prepared for mounting. The tunnel wall must then be worked with tools to mechanically install the mounting for the sensor. Lastly, the sensor unit must be mounted in place and aligned. If any step fails, then a new location must be found and the process repeated.

For the above referenced reasons, the installation of sensors in a railway tunnel requires a large commitment of equipment and labor. Furthermore, the railway tunnel must be shut down to traffic while the installation takes place. If the work is only performed during overnight, low traffic time, it can take many months, possibly years to install electronic sensors and other wayside equipment along any one railway line. The cost in time, labor and line closures, therefore, makes the modernization of railway lines with electronic sensors unappealing to many railway operators.

A need therefore exists for a system and method of installing wayside equipment in railway tunnels, that is labor efficient, cost effective and time efficient. This need is met by the present invention as described and claimed below.

SUMMARY OF THE INVENTION

The present invention is an automated system and method of mounting wayside equipment on a surface that is adjacent to railway tracks. The system is mounted to a railway car that is capable of traveling on the railway tracks. As the railway car travels, it passes the walls onto which electronics units are to be mounted. The railway car is equipped with odometry equipment that automatically measures the location of the railway car in relation to the tracks in order to stop the train at predetermined installation waypoints and to record actual installation locations.

A robot is carried by the railway car. The robot has an articulating arm that can reach between the railway car and the surface adjacent to the railway tracks. The robot is provided with a rack of working head units. The robot can connect to, and disconnect from, the various working head units in order to perform different tasks. The tasks performed by the robot include scanning the surface for defects and obstructions that may prevent a proper mounting, drilling holes in the surface, mounting bolts in the holes, mounting brackets to the bolts, and connecting electronics units to the brackets. The robot can optionally clean the mounting site and test the mounting site for signal strength.

The robot repeats its actions as the railway car moves along the railway tracks. In this manner, a series of electronics units can be mounted along a railway in a labor and cost-efficient manner.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention system and method can be embodied in many ways in order to install different wayside equipment, only one exemplary embodiment is illustrated for the purposes of description and discussion. The exemplary embodiment shows an electronic sensor being installed. The exemplary embodiment is selected in order to set forth one of the best modes contemplated for the invention. The illustrated embodiment, however, is merely exemplary and should not be considered a limitation when interpreting the scope of the appended claims.

Figure 1:
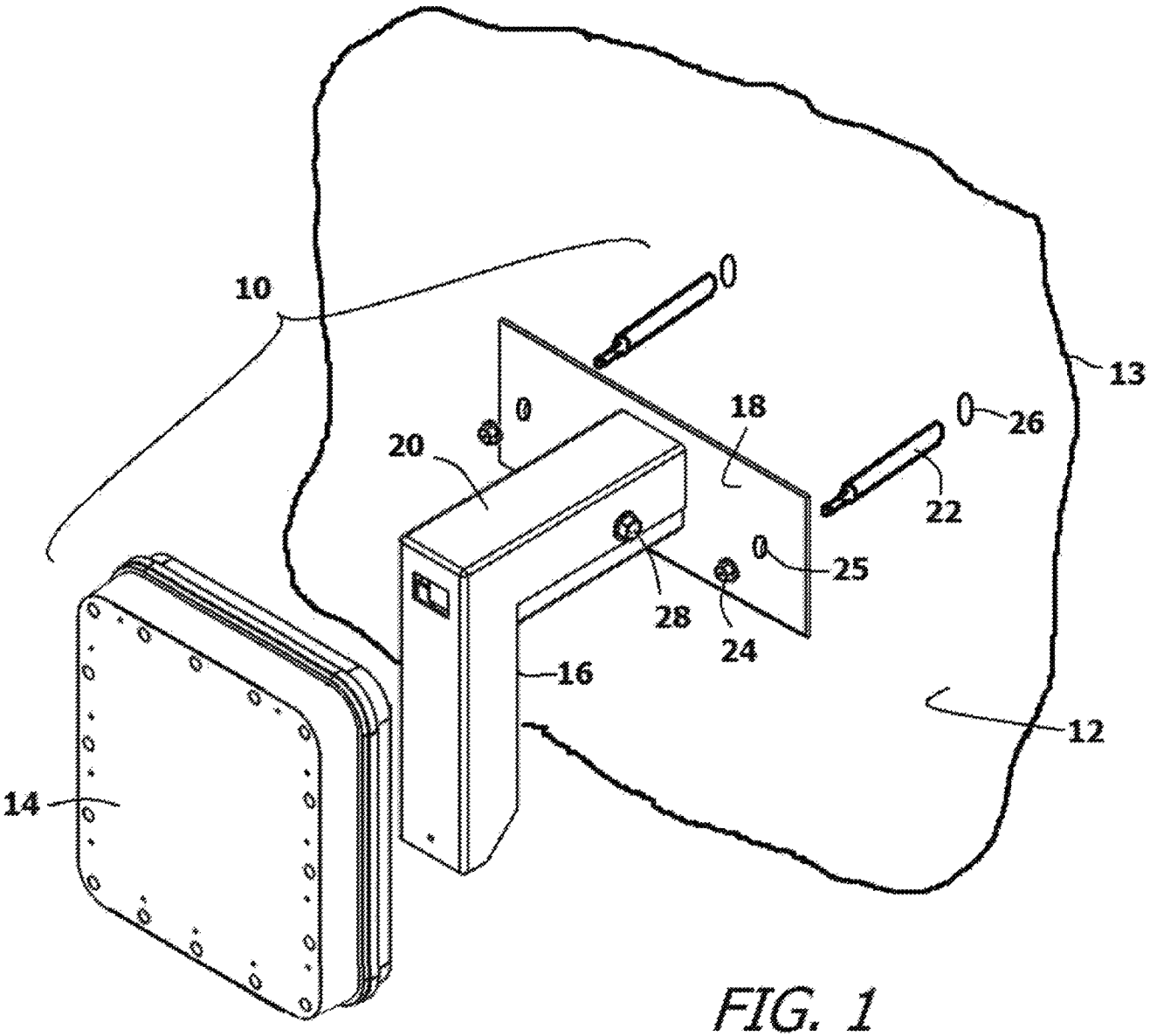
FIG. 1 is a perspective view of an exemplary embodiment of a sensor assembly being installed using the present invention installation system and method.

The present invention is a system and method of installing wayside equipment onto the walls 12 of railway tunnels 13. Referring to FIG. 1, an exemplary sensor assembly 10 is shown as one type of wayside equipment. The sensor assembly 10 includes an electronics unit 14 and a supporting mounting bracket 16. The mounting bracket 16 has a base plate 18 and a neck 20 that extends from the base plate 18. The base plate 18 connects to the tunnel wall 12. The neck 20 extends from the base plate 18 and interconnects with the electronics unit 14.

The mounting bracket 16 is bolted to the wall 12 of the railway tunnel 13. The base plate 18 of the mounting bracket 16 is flat and can only be mounted to a generally flat wall surface that contains irregularities and a curvature below within acceptable ranges. The acceptable ranges for surface irregularities and curvature vary with the area of the base plate 18.

Anchor bolts 22 and nuts 24 are used to fasten the mounting bracket 16 directly to the wall 12 of the tunnel 13. Holes 25 are formed through the base plate 18 to accommodate the anchor bolts 22. The anchor bolts 22 are driven directly into the wall 12 of a tunnel 13, wherein the anchor bolts 22 must be advanced into bolt holes 26 that have been drilled into the wall 12. Once engaged with the wall 12, the nuts 24 are used to engage the anchor bolts 22 and connect the base plate 18 to the wall 12. A separate nut and bolt 28 are also used to adjust the mounting neck 20. Once adjusted, the electronics unit 14 is connected to the mounting neck 20. It will be understood that the base plate 18, mounting neck 20 and electronics unit 14 can all vary in shape and size depending upon the type of sensor assembly 10 being installed and the dimensions available within the railway tunnel 13.

Figure 2:
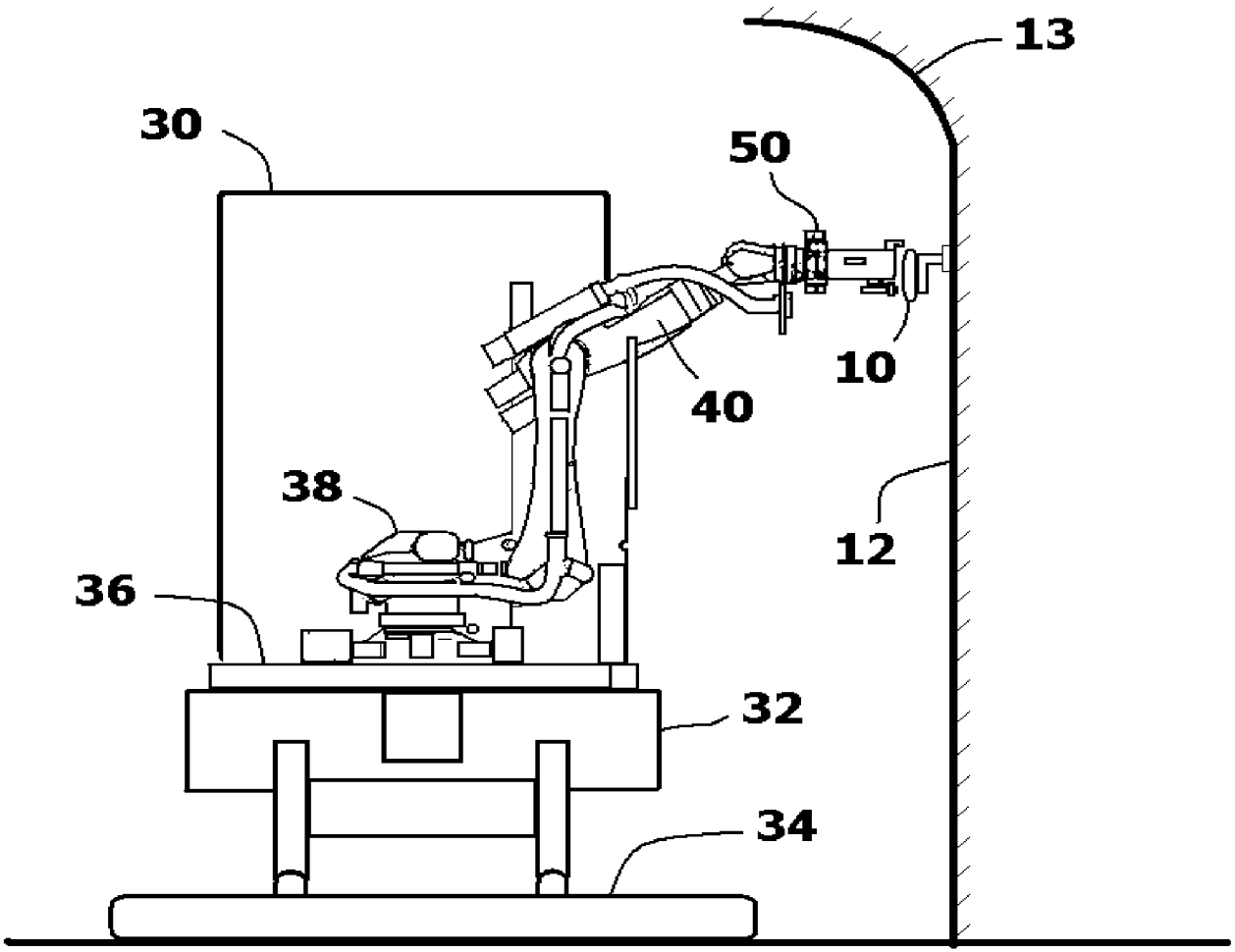
FIG. 2 shows an exemplary embodiment of the installation system installing the sensor assembly of FIG. 1 onto a surface of a railway tunnel.
Figure 3:
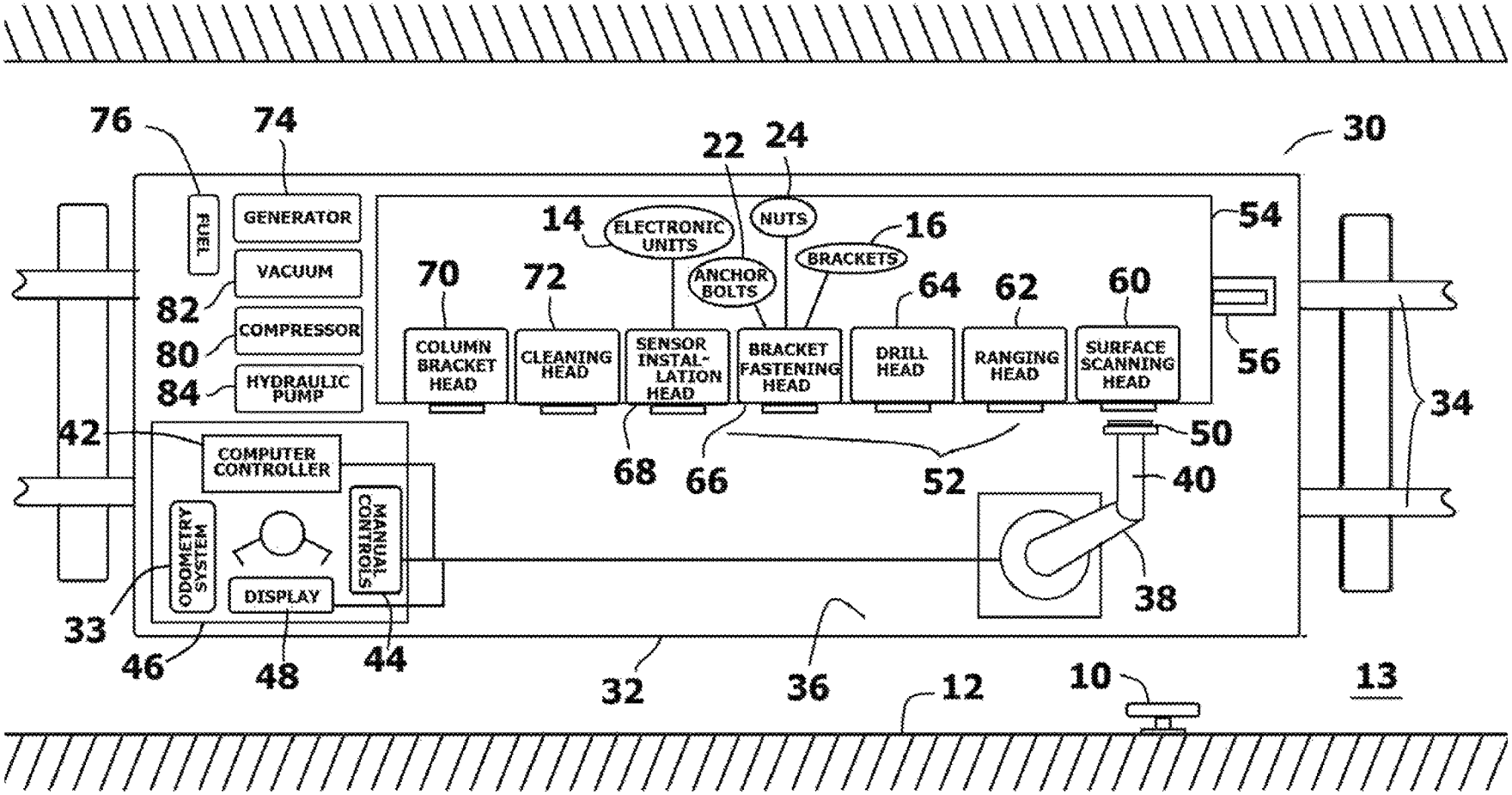
FIG. 3 is a schematic of the exemplary installation system shown in FIG. 2.

Referring to FIG. 2 and FIG. 3, the installation system 30 is shown. The installation system 30 is mounted on a railway car 32 that rides on the rails 34 through the railway tunnel 13. The railway car 32 is selected to meet the gauge, length, width and height requirements of the railway system. In this manner, the railway car 32 can be moved along the tracks of the railway system during the installation process. The railway car 32 has odometry equipment 33 that can automatically measure the relative position of the railway car 32 as it travels along the rails 34. This positional information enables the railway car 32 to travel to desired installation locations and measure the final installation position of the electronics unit 14.

The railway car 32 has a work platform 36. A robot 38 is positioned on the work platform 36. The robot 38 has an articulating arm 40 that is capable of reaching from the work platform 36 to the wall 12 of the railway tunnel 13. The robot 38 is programmable. As such, it is capable of repeatedly performing programmed movements. Additionally, the robot 38 can also be manually controlled by a trained operator. A computer controller 42 for the robot 38 and manual controls 44 of the robot 38 are positioned in an operator's station 46 on the work platform 36. Additionally, one or more display screens 48 are provided at the operator's station 46, wherein an operator can remotely view various camera feeds, robot control data and other feedback data needed to operate the robot 38 and oversee its work.

The articulated arm 40 of the robot 38 terminates with a tool head coupler 50. The tool head coupler 50 enables the articulating arm 40 to selectively connect to, and disconnect from, a variety of working head units 52. Each working head unit 52 serves a different purpose, as will be later explained. The working head units 52 are held at indexed positions on a tool rack 54. In this manner, the positions of the various working head units 52 is programmed into the robot 38 and the articulating arm 40 can interconnect with, and disconnect from, any of the working head units 52 on the tool rack 54. If all of the working head units 52 on the tool rack 54 are within the reach of the articulating arm 40, then both the tool rack 54 and the robot 38 can be set into fixed positions. However due to the size and number of the working head units 52, either the tool rack 54 and/or the robot 38 can be mounted on tracks 56 that enable the robot 38 and the tool rack 54 to move relative to one another, therein providing access to all the working head units 52.

The working head units 52 provided on the tool rack 54 depend upon the requirements of the installation project. In the shown embodiment, the working head units 54 include a surface scanning head 60, a ranging head 62, a drill head 64, a bracket fastening head 66, and a sensor installation head 68. Optional additional working head units 52 include a column bracket head 70 and a cleaning head 72. The different working head units 52 may require electrical power, pneumatic pressure, and or hydraulic pressure to operate. Such supplies are carried on the railway car 32. For instance, the railway car 32 may include a generator 74 and fuel 76 to operate the generator 74. The generator 74 can supply the electrical power needed to operate the robot 38 as well as the power needed to operate, for example, an air compressor 80, a filtered vacuum 82 and/or a hydraulic pump 84. In this manner, the overall installation system 30 is self-sufficient for operations and no hoses or wires need to be extended through the railway tunnel 13. The railway car 32 is also supplied with the various parts that are to be installed within the railway tunnel 13. Those parts include the electronics unit 14 and brackets 16 of the sensor assemblies 10, as well as the anchor bolts 22 and the nuts 24. Each of these parts are held in supply bins on the railway car 32. The parts may be fed to specific pickup locations that can be accessed by the robot 38. Alternatively, the parts can be loaded into the various working head units 52 prior to the working head units 52 being engaged by the robot 38.

Figure 4:
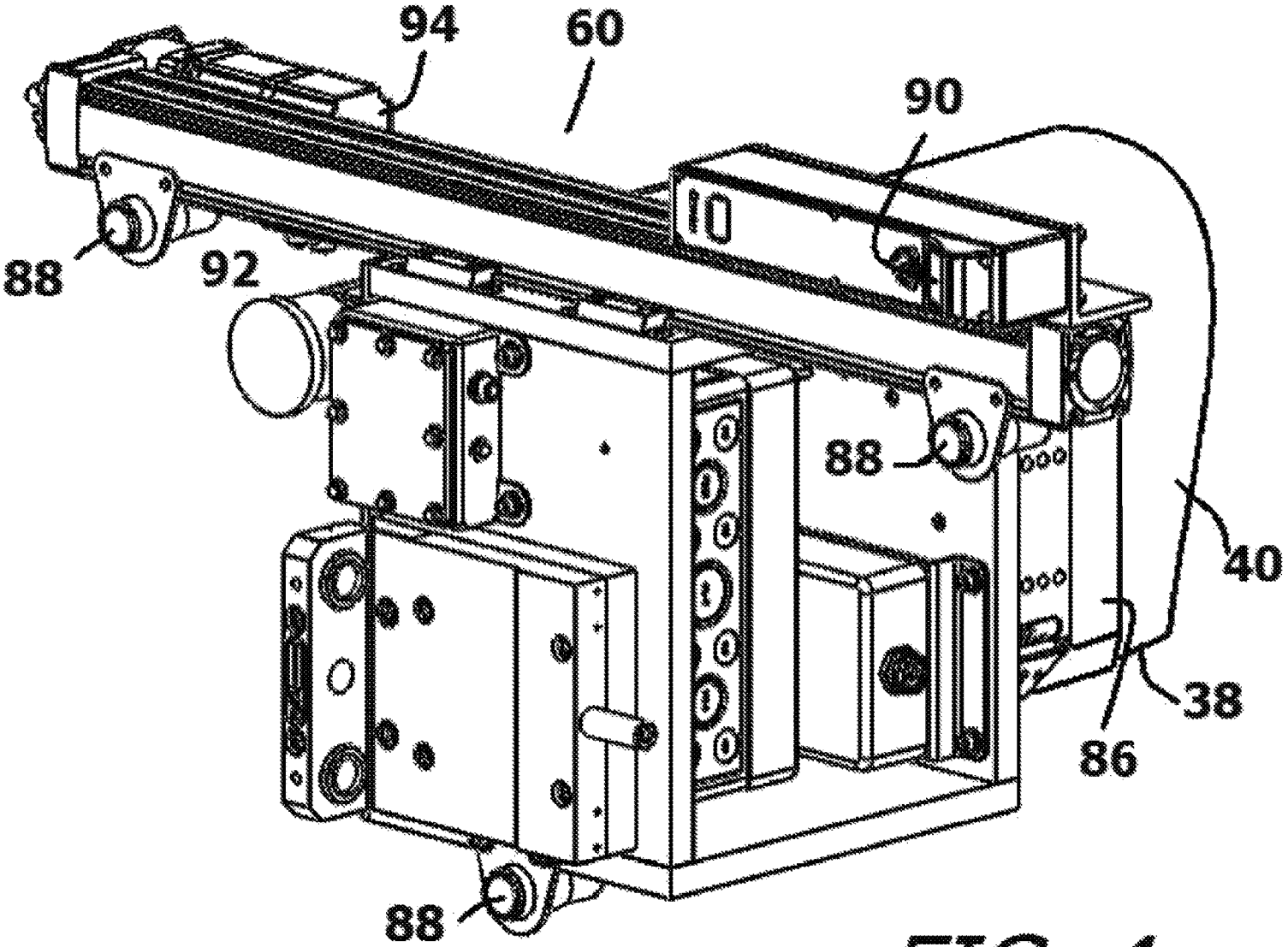
FIG. 4 shows an exemplary embodiment for a surface scanning head, which is utilized by the installation system of FIG. 2 and FIG. 3.

One of the working head units 52 operated by the robot 38 is the surface scanning head 60. Referring to FIG. 4 in conjunction with FIG. 3, it can be seen that the surface scanning head 60 has a coupler 86 that can be selectively engaged by the articulating arm 40 of the robot 38. The surface scanning head 60 includes an array of infrared distance sensors 88. The distance sensors 88 detect the distance between the surface scanning head 60 and the wall 12, so that the position of the robot 38 and the articulating arm 40 relative the tunnel wall 12 becomes known.

At least one surface profiling device 90, such as a camera, is provided. The camera 90 is connected to a slide 92 and is scanned back and forth across an area of interest on the tunnel wall 12 by a linear actuator 94. The camera 90 creates a depth map of the scanned area. By analyzing the depth mapping data, it can be determined if the area of interest is flat, defect-free, not curved, free of foreign objects, lacks surface irregularities, and is otherwise appropriate for use in mounting.

Figure 5:
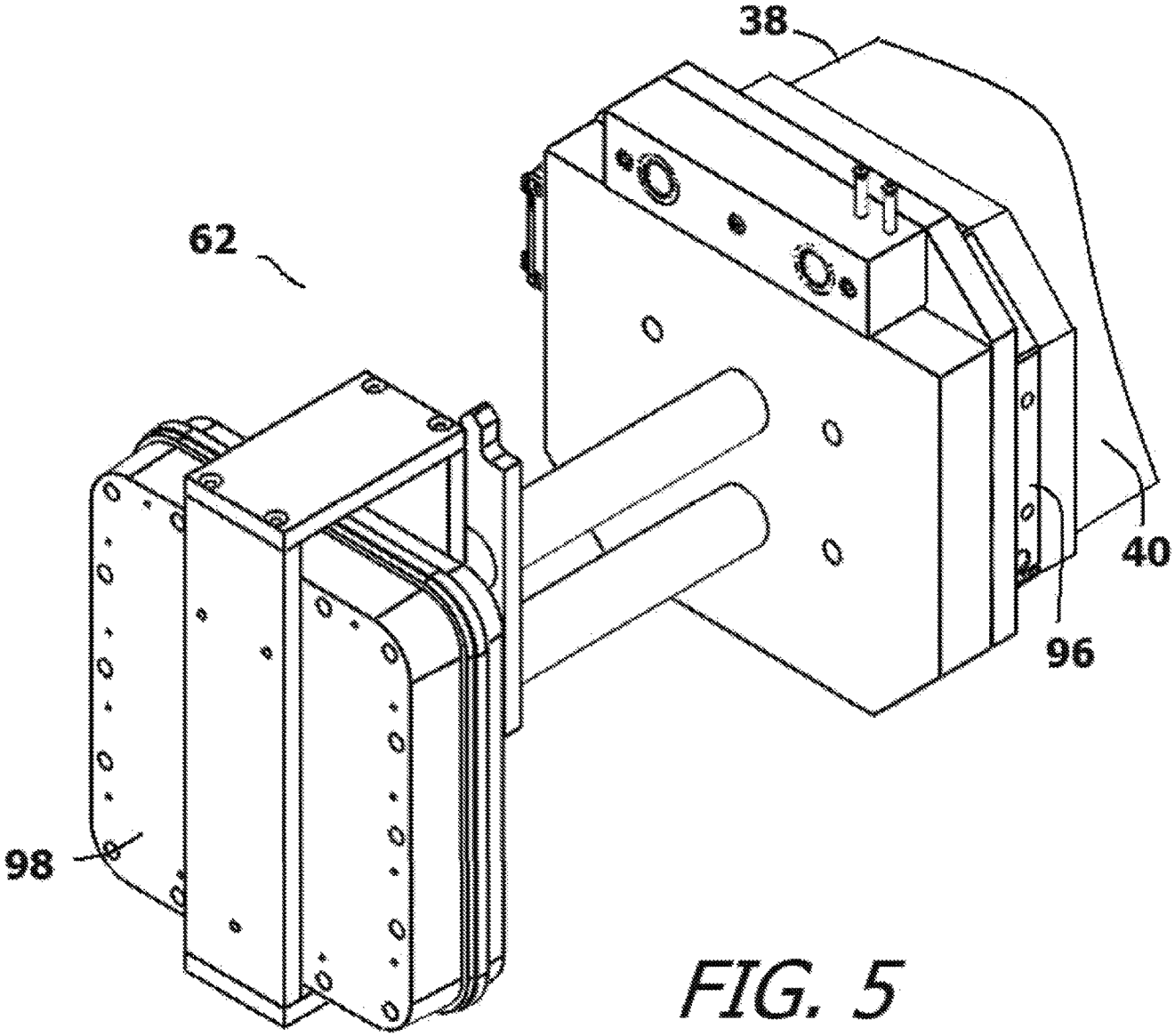
FIG. 5 shows an exemplary embodiment for a ranging head, which is utilized by the installation system of FIG. 2 and FIG. 3.

A ranging head 62 can also be operated by the robot 38. Referring to FIG. 5, it can be seen that the ranging head 62 has a coupler 96 that can be selectively engaged by the articulating arm 40 of the robot 38. The ranging head 62 contains a test electronics unit 98. The test electronics unit 98 can simulate the operations of the real electronics units 14 (FIG. 1) being installed. The ranging head 62 is moved by the robot 38 so that the test electronics unit 98 is positioned and oriented in the same place that the actual electronics unit 14 (FIG. 1) will occupy, should it be installed. The ranging head 62 tests if a sensor unit set into such a position and orientation would be unobstructed and can properly communicate with an adjacent sensor unit that has been earlier installed.

Figure 6:
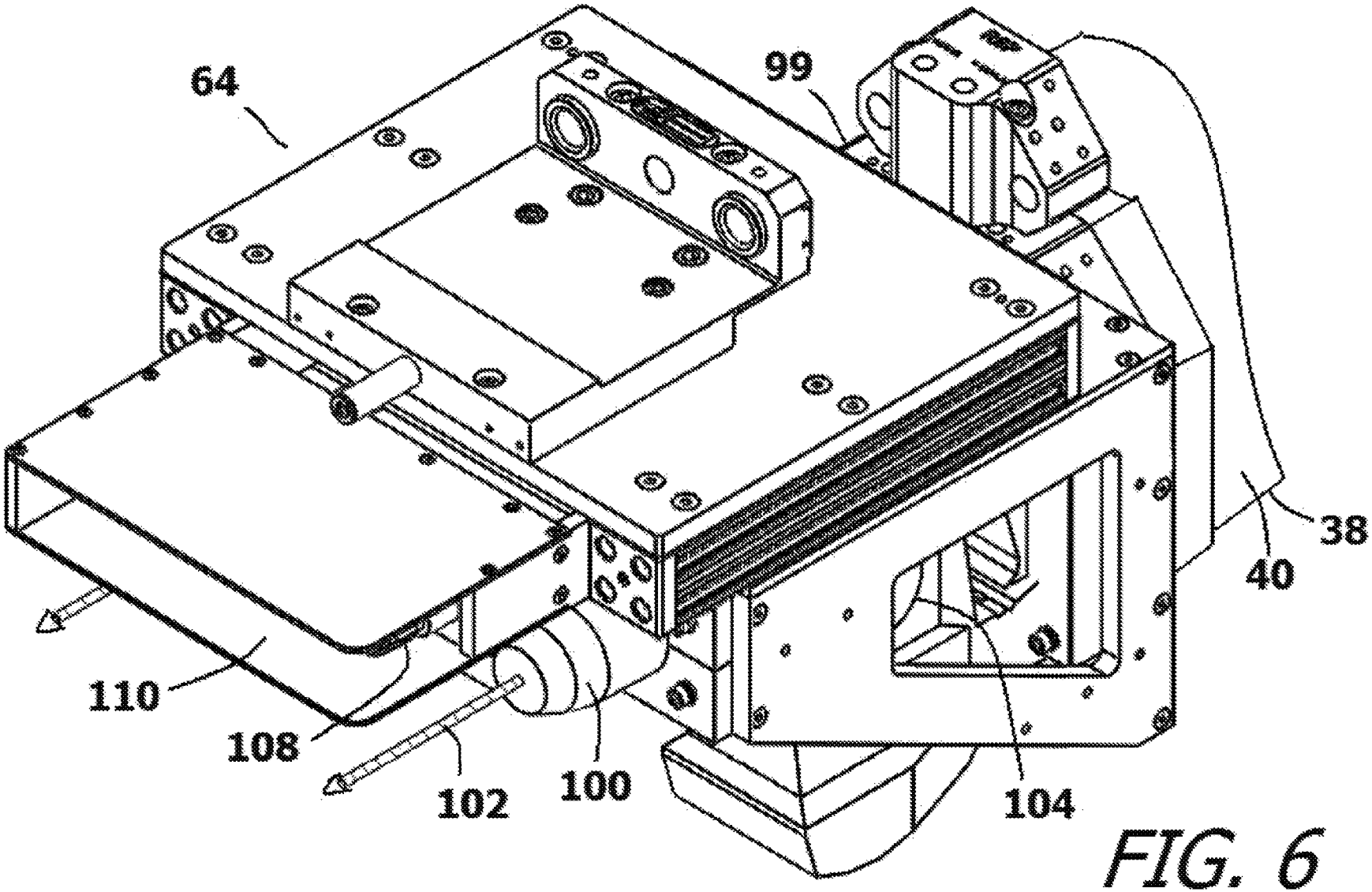
FIG. 6 shows an exemplary embodiment for a drill head, which is utilized by the installation system of FIG. 2 and FIG. 3.

Referring to FIG. 6 in conjunction with FIG. 2 and FIG. 3, an exemplary drill head 64 is explained. The drill head 64 has a coupler 99 that can be selectively engaged by the articulating arm 40 of the robot 38. The drill head 64 contains hammer drills 100 that can be electrically, pneumatically or hydraulically powered. The hammer drills 100 hold drill bits 102 at positions that correspond to mounting points needed to mount the sensor assembly 10 of FIG. 1. The drill bits 102 are sized to create the bolt holes 26 needed to receive the anchor bolts 22. The hammer drills 100 are advanced by the robot 38, wherein the robot 38 can detect the force being applied to advance the hammer drills 100 during operation. The drill head 64 may also contain blowing nozzles 108 for blowing air toward the tunnel wall 12 and removing dust created by the hammer drills 100. An evacuation port 110 can also be provided that is connected to the filtered vacuum 82. In this manner, the dust and debris created by the drill head 64 can mostly be recovered, thereby eliminating the need for any secondary cleaning of the railway tunnel 13.

Figure 7:
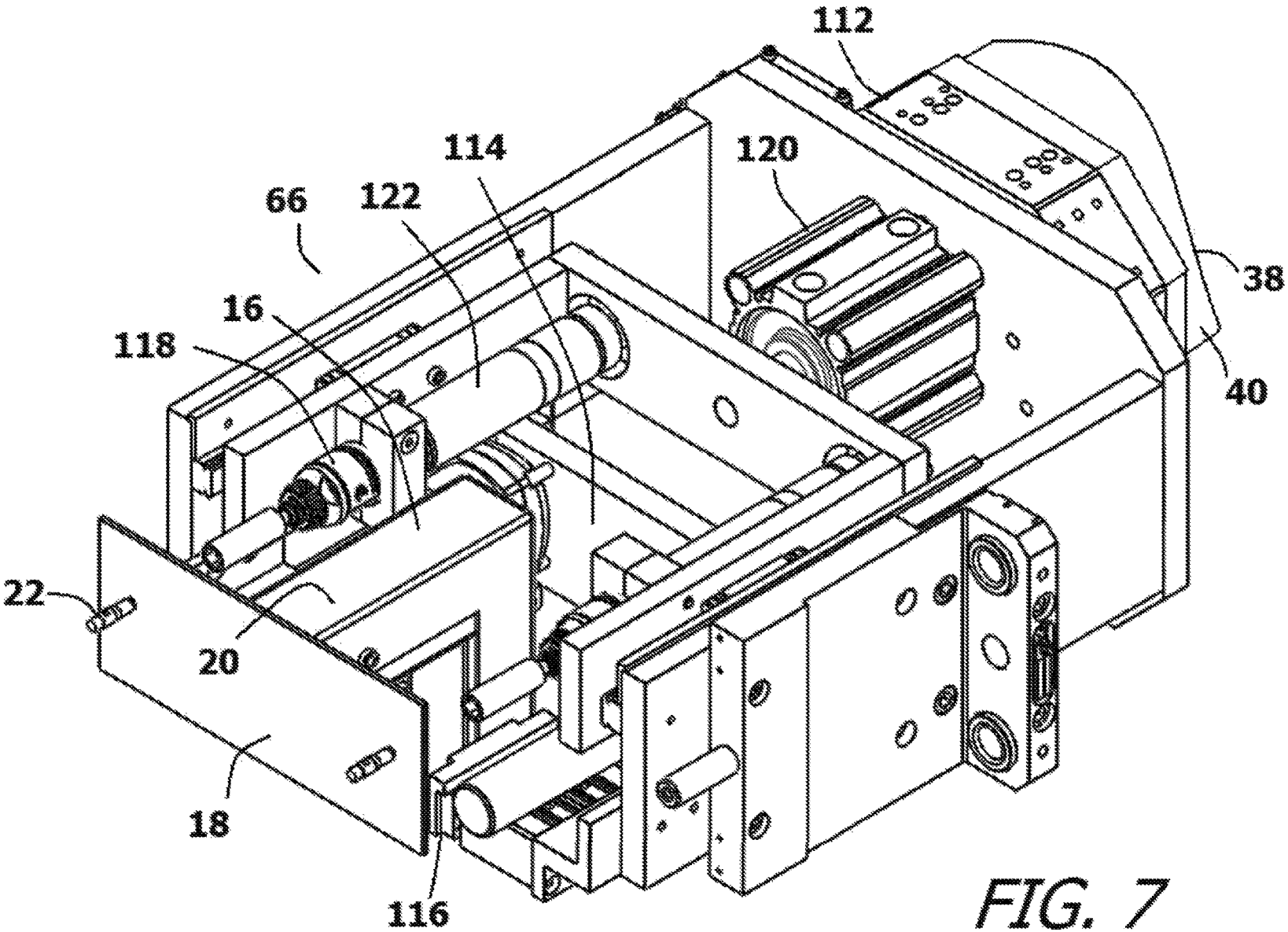
FIG. 7 shows an exemplary embodiment for a bracket fastening head, which is utilized by the installation system of FIG. 2 and FIG. 3.

Referring to FIG. 7 in conjunction with FIG. 2 and FIG. 3, an exemplary bracket fastening head 66 is shown. The bracket fastening head 66 has a coupler 112 that can be selectively engaged by the articulating arm 40 of the robot 38. The bracket fastening head 66 has a receptacle area 114 and gripper 116 that can lift and retain a base plate 18 and neck 20 of a mounting bracket 16. The bracket fastening head 66 also contains chucks 118 for holding a set of anchor bolts 22 and drive hammers 120 that can be used to drive the anchor bolts 22 into pre-drilled bolt holes 26. The bracket fastening head 66 also contains powered nut runners 122 that are capable of holding nuts 24 and driving those nuts 24 onto the anchor bolts 22.

Figure 8:
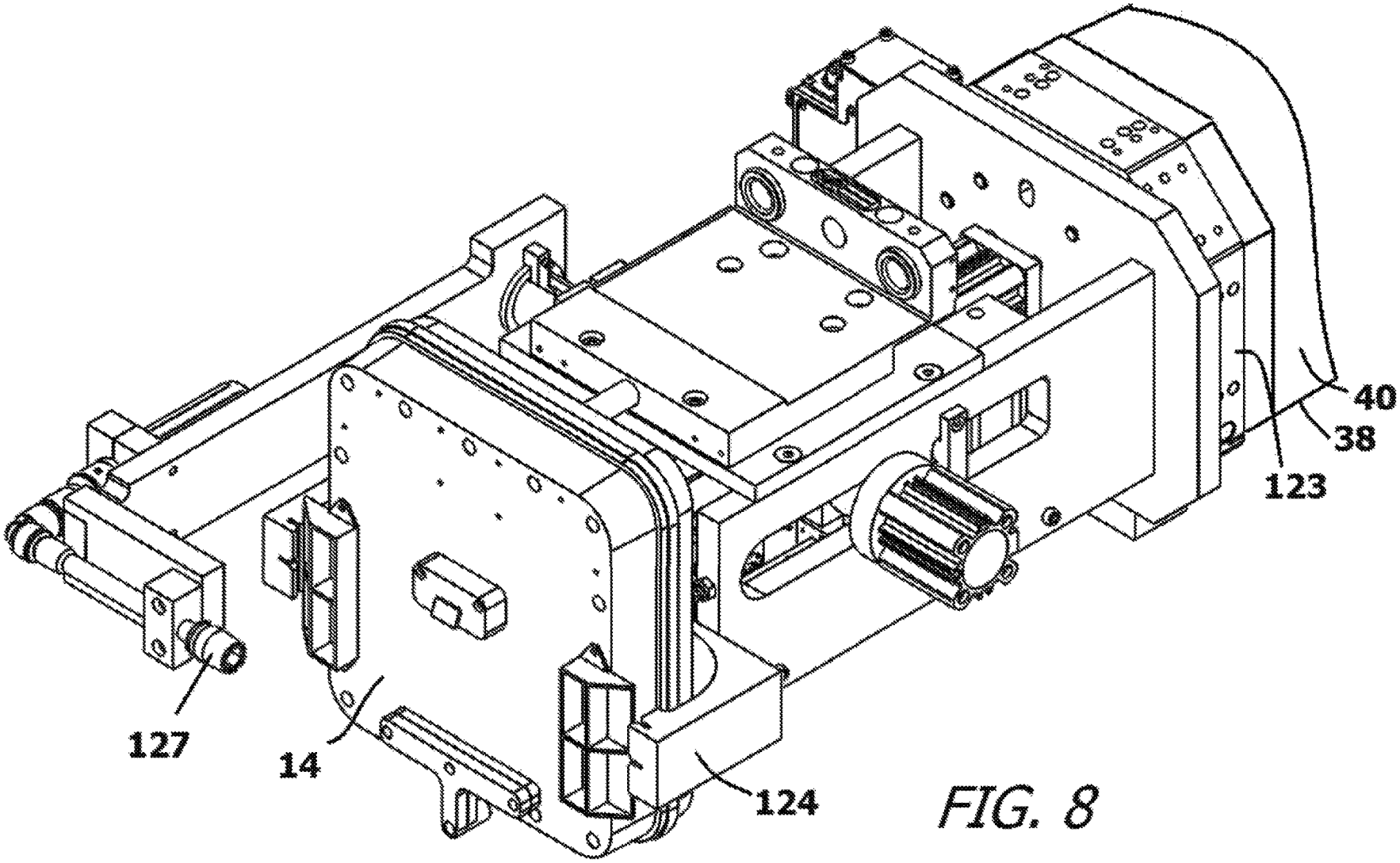
FIG. 8 shows an exemplary embodiment for a sensor installation head, which is utilized by the installation system of FIG. 2 and FIG. 3.

Referring to FIG. 8, an exemplary sensor installation head 68 is shown. The sensor installation head 68 has a coupler 123 that can be selectively engaged by the articulating arm 40 of the robot 38. The sensor installation head 68 has a clamp 124 that can grip the electronics unit 14. The sensor installation head 68 also has a nut runner 127 that can engage the nut and bolt 28 on the neck 20 of the mounting bracket 16, therein adjusting the mounting bracket 16.

Figure 9:
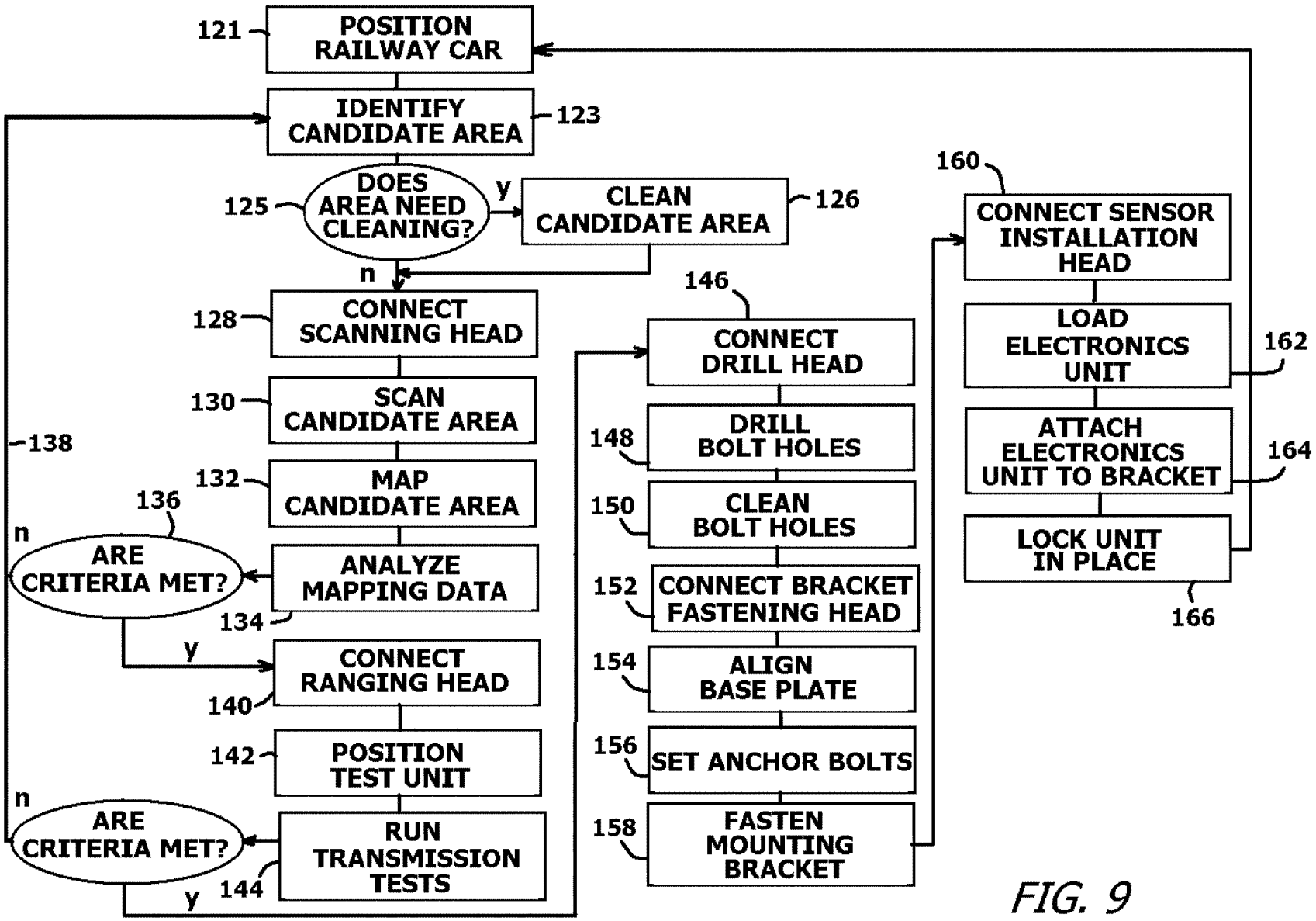
FIG. 9 is a block logic flow diagram outlining a methodology for operations.

Referring to FIG. 9 in conjunction with all previous figures, the methodology of using the installation system 30 is explained. The railway car 32 is loaded and taken into a tunnel 13 where the sensor assemblies 10 are to be mounted. The railway car is positioned using the odometry equipment 33. See Block 121. Once in the correct location, the operator visually scans the wall 12 of the tunnel 13 looking for some candidate area that is not obviously inappropriate. See Block 123. If the candidate area is particularly dirty to a point where the surface characteristics of the tunnel wall 12 cannot be readily ascertained, then the operator can optionally clean the candidate area. See Block 125 and Block 126. To clean the candidate area, the operator can instruct the robot 38 to connect to the cleaning head 72. The cleaning head 72 can contain wheel brushes and/or blowers that can remove some of the contamination from the tunnel wall 12. The type of cleaner head 72 can be customized to the contamination type common within a particular railway tunnel.

After the candidate area is cleaned, or if the candidate area does not require cleaning, then a scanning subroutine is executed. In executing the scanning subroutine, the robot connects to the surface scanning head 60. See Block 128. The articulating arm 40 of the robot 38 moves the surface scanning head 60 to the candidate area. See Block 130. The infrared distance sensors 88 provide feedback and cause the robot 38 to hold the surface scanning head 60 at a predetermined distance from the candidate area. The camera 90 is then used to create a depth map of the tunnel wall 12 within the candidate area. See Block 132. The depth map is analyzed by the computer controller 42 to determine if the candidate area meets threshold criteria. See Block 134. The threshold criteria include, but are not limited to, a certain degree of flatness, the lack of obstructions, the lack of cracks, the lack of joints, and the lack of surface moisture.

If the candidate area fails to meet the set criteria, then the operator selects another candidate area and the initial steps are repeated. See Block 136 and loop line 138. If the candidate area meets the initial criteria, then the robot changes the working head to a ranging head 62. See Block 140. The ranging head 62 includes a test electronics unit 98. The robot 38 positions the test electronics unit 98 in the position being considered for the real sensor assembly 10. See Block 142. Transmission tests are then run using the test electronics unit to ensure that communications are clear and unencumbered. See Block 144. If the transmission test fails, then the operator selects another candidate area and the initial steps are repeated. See Block 136. If the transmission test is successful, then the physical installation of the sensor assembly 10 begins.

The robot 38 changes working heads to the drill head 64. See Block 146. The robot 38 knows the location of the candidate area from the data received using the surface scanning head 60. The robot 38 moves the drill head 64 to the candidate area and begins drilling two bolt holes 26 using the hammer drills 100. See Block 148. The hammer drills 100 are monitored for a minimum drill rate and a maximum drill force. For example, a minimum drill rate can be 5 millimeters per second. A maximum drill force can be one-hundred newtons. The hammer drills 100 are operated until the bolt holes 26 are deep enough to receive the anchor bolts 22 therein. If the hammer drills fail to meet the drilling criteria for minimum drill rate and maximum drill force, then it can be assumed that the drill site is inappropriate. This may be due to an obstruction, such as a segment of rebar set behind the concrete of the tunnel wall 12. If this is the case, the operator selects another candidate area and the initial steps are repeated. See Block 136.

As the bolt holes 26 are drilled, the drilling debris is removed using the blow nozzles 108, wherein the debris is drawn into the evacuation port 110. The final drilled bolt holes 26 are also blown clean, to ensure no debris remains within the drilled bolt holes 26. See Block 150.

Once the bolt holes 26 are drilled and cleaned, the robot 38 changes to the bracket fastening head 66. See Block 152. The bracket fastening head 66 is loaded with the mounting bracket 16 of a sensor assembly 10, two anchor bolts 22 and two nuts 24. The robot 38 moves the base plate 18 against the tunnel wall 12 and aligns the holes in the base plate 18 with the bolt holes 26 drilled into the tunnel wall 12. See Block 154. Once the base plate 18 of the mounting bracket 16 is aligned, the anchor bolts 22 are driven into the bolt holes 26 using the drive hammers 120. See Block 156. After the anchor bolts 22 are fully set into the bolt holes 26, the nut runner 116 on the bracket fastening head 66 threads the nuts 24 onto the anchor bolts 22, therein bolting the mounting bracket 16 into place. See Block 158.

Once the mounting bracket 16 is in place, the robot 38 changes working heads to the sensor installation head 68. See Block 160. The sensor installation head 68 has a clamp 124 that is loaded with the electronics unit 14. See Block 162. The robot 38 manipulates the sensor installation head 68 until the electronics unit 14 engages the previously installed mounting bracket 16. See Block 164. The nut runner 126 on the sensor installation head 68 engages and tightens the nut and bolt 28 on the mounting bracket 16. This locks the electronics unit 14 in place on the mounting bracket 16, therein completing the installation.

Once the installation is complete, the railway car 32 is advanced along the track and the process is repeated. See Block 168.

Figure 10:
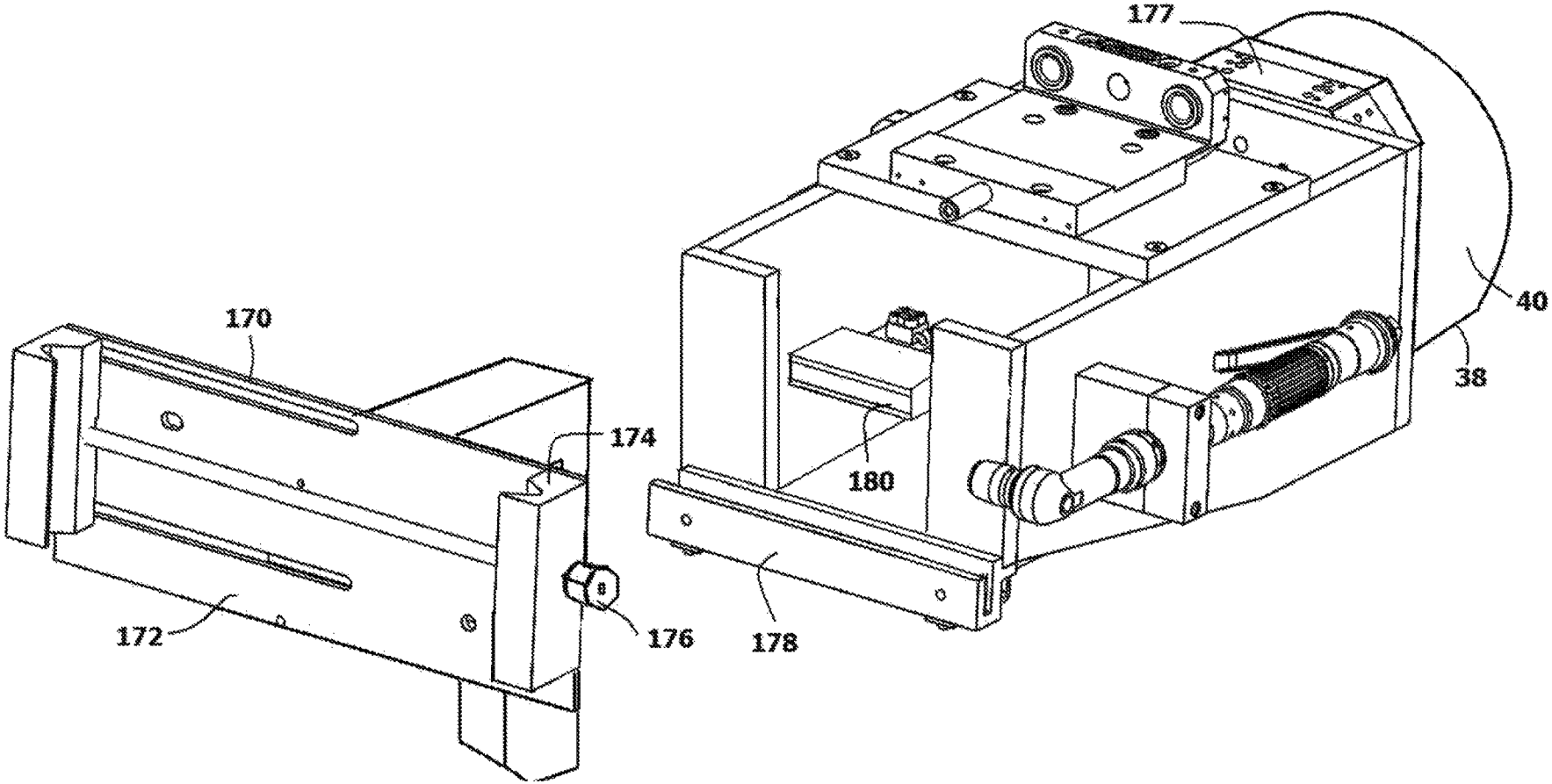
FIG. 10 shows an exemplary embodiment for a column bracket head, which is utilized by the installation system of FIG. 2 and FIG. 3.

Many railway tunnels have I-beam supports spaced along the length of the tunnel. The I-beam supports protrude into the tunnel and often block otherwise good mounting locations for sensor assemblies. Referring to FIG. 10, a column bracket head 70 is shown. The column bracket head 70 is used to mount an electronics unit 14 directly to an I-beam support, rather than to the wall of the railway tunnel. The use of the column bracket head 70 requires a specialized mounting bracket 170 be used to hold the electronics unit 14. The mounting bracket 170 has a clamping base plate 172 with opposing jaws 174 that can be selectively tightened and loosened by turning a nut 176.

The column bracket head 70 has a coupler 177 that can be selectively engaged by the articulating arm 40 of the robot 38. A support ledge 178 and gripper 180 are used to hold the specialized mounting bracket 170 in place. The robot 38 manipulates the column bracket head 70 and the specialized mounting bracket 170 until the clamping base plate 172 is pressed against the face of an I-beam. The jaws 174 are then tightened, therein attaching the specialized mounting bracket 170 to the I-beam. The robot 38 can then use the sensor installation head 68 (FIG. 8) to attach an electronics unit 14 to the specialized mounting bracket 170 in the manner previously described. The attachment of electronics units 14 to I-beams can be integrated with the described methodology of attaching electronics units to walls, should the attachment to an I-beam be more practical at a given location.

It will be understood that the embodiment of the present invention that is illustrated and described is merely exemplary and that a person skilled in the art can make many variations to that embodiment. All such embodiments are intended to be included within the scope of the present invention as defined by the claims.

What is claimed is:

1. A method of mounting wayside equipment on a surface that is adjacent to railway tracks, said method comprising the steps of:

providing a railway car capable of traveling on said railway tracks adjacent to said surface;

providing a robot on said railway car;

providing working head units for said robot on said railway car, wherein said robot is capable of selecting and extending one of said working head units from said railway car to said surface, and wherein one of said working head units is a scanning head with a surface profiler;

providing a mounting bracket that is accessible by said robot on said railway car;

scanning said surface with said scanning head for an installation site appropriate for receiving said mounting bracket;

attaching said mounting bracket to said installation cite utilizing said robot; and attaching said wayside equipment to said mounting bracket utilizing said robot.

2. The method according to claim 1, wherein said robot moves said scanning head from said railway car toward said surface to scan said installation site with said scanning head.

3. The method according to claim 1, wherein attaching said mounting bracket to said surface includes drilling holes in said surface.

4. The method according to claim 3, wherein one of said working head units is a drill head for drilling said holes, wherein said robot moves said drill head from said railway car toward said surface to drill said holes with said drill head.

5. The method according to claim 3, wherein attaching said mounting bracket to said surface includes setting anchor bolts in said holes.

6. The method according to claim 5, wherein one of said working head units includes a powered hammer for driving said anchor bolts into said holes, wherein said robot moves said powered hammer from said railway car toward said surface to drive said anchor bolts into said holes.

7. The method according to claim 3, wherein attaching said mounting bracket to said surface includes affixing said mounting bracket to said anchor bolts with said robot.

8. The method according to claim 1, further including testing said installation site by positioning a test electronics unit onto said installation site with said robot and running tests using said test electronics unit.

9. The method according to claim 1, further including cleaning said installation site using said robot.

10. A method of mounting wayside equipment on a surface that is adjacent to railway tracks, said method comprising the steps of:

providing a railway car capable of traveling on said railway tracks adjacent to said surface;

providing a robot on said railway car;

providing a mounting bracket that is accessible by said robot on said railway car;

providing working head units for said robot on said railway car, wherein said robot is capable of selecting and extending one of said working head units from said railway car to said surface, and wherein said working head units include a first working head for drilling holes in said surface, a second working head for installing said mounting bracket and another working head that scans said surface for an installation site appropriate for receiving said mounting bracket;

attaching said mounting bracket to said surface utilizing said working head units as manipulated by said robot; and attaching said wayside equipment to said mounting bracket.

11. The method according to claim 10, wherein said second working head sets anchor bolts in said holes and connects said mounting bracket to said anchor bolts.

12. The method according to claim 10, wherein said working head units include a third working head that is manipulated by said robot and attaches said wayside equipment to said mounting bracket.

13. The method according to claim 10, wherein said working head units include a fifth working head that cleans said installation site.

14. The method according to claim 10, wherein said installation site is on a beam and said working head units include a working head that attaches said mounting bracket to said beam.

* * * * *